US009199774B2

(12) United States Patent
Smalley et al.

(10) Patent No.: US 9,199,774 B2
(45) Date of Patent: Dec. 1, 2015

(54) CARTON WITH HANDLE

(75) Inventors: Brian Smalley, Bristol (GB); Steve M. Gould, Bristol (GB); Jon Thompson, Bristol (GB)

(73) Assignee: Graphic Packaging International, Inc., Atlanta, GA (US)

( * ) Notice: Subject to any disclaimer, the term of this patent is extended or adjusted under 35 U.S.C. 154(b) by 554 days.

(21) Appl. No.: 13/273,618

(22) Filed: Oct. 14, 2011

(65) Prior Publication Data

US 2012/0091190 A1 Apr. 19, 2012

Related U.S. Application Data

(60) Provisional application No. 61/455,269, filed on Oct. 18, 2010.

(51) Int. Cl.
*B65D 65/00* (2006.01)
*B65D 75/00* (2006.01)
(Continued)

(52) U.S. Cl.
CPC ..... *B65D 71/20* (2013.01); *B65D 71/14* (2013.01); *B65D 71/32* (2013.01); *B65D 71/36* (2013.01); *B65D 2571/0066* (2013.01); *B65D 2571/00141* (2013.01); *B65D 2571/00277* (2013.01); *B65D 2571/00444* (2013.01); *B65D 2571/00469* (2013.01); *B65D 2571/00543* (2013.01); *B65D 2571/00567* (2013.01); *B65D 2571/00716* (2013.01)

(58) Field of Classification Search
CPC ..... B65D 2571/0066; B65D 2571/00716; B65D 2571/00277; B65D 2571/00444; B65D 5/3621; B65D 65/00; B65D 75/00
USPC ..... 206/427, 434, 435; 229/117.13–117.15
See application file for complete search history.

(56) References Cited

U.S. PATENT DOCUMENTS 1,253,193 A 1/1918 Hill
2,375,631 A 5/1945 DeVillard
(Continued)

FOREIGN PATENT DOCUMENTS

BE 671762 3/1966
CA 8777792 8/1971
(Continued)

OTHER PUBLICATIONS

International Search Report and Written Opinion for PCT/US2011/056307 dated May 21, 2012.
(Continued)

*Primary Examiner* — Luan K Bui
*Assistant Examiner* — Rafael Ortiz
(74) *Attorney, Agent, or Firm* — Womble Carlyle Sandridge & Rice, LLP

(57) ABSTRACT

A carton for carrying a plurality of articles. The carton comprises at least one bottom panel, a first side panel foldably connected to at least one bottom panel, a second side panel foldably connected to the at least one bottom panel, and a top panel foldably connected to at least one of the first side panel and the second side panel. A handle comprises at least one handle flap foldably connected to the top panel at a fold line. The at least one handle flap has a first width corresponding to a maximum width of the last least one handle flap. The top panel has a second width corresponding to a minimum distance between a first edge and a second edge of the top panel. The first width is less than the second width.

28 Claims, 8 Drawing Sheets

(51) Int. Cl.

| | |
|---|---|
| ***B65D 71/20*** | (2006.01) |
| ***B65D 71/14*** | (2006.01) |
| ***B65D 71/32*** | (2006.01) |
| ***B65D 71/36*** | (2006.01) |

(56) References Cited

U.S. PATENT DOCUMENTS

| | | | | | |
|---|---|---|---|---|---|
| 2,383,183 | A | | 8/1945 | Fischer | |
| 2,594,376 | A | | 4/1952 | Arneson | |
| 2,702,144 | A | | 2/1955 | Forrer | |
| 2,718,301 | A | | 9/1955 | Palmer | |
| 2,785,847 | A | | 3/1957 | Forrer | |
| 2,797,856 | A | | 7/1957 | Jaeschke | |
| 2,810,506 | A | | 10/1957 | Kessler | |
| 2,811,250 | A | | 10/1957 | Arneson | |
| 2,849,111 | A | | 8/1958 | Fielding | |
| 2,868,433 | A | | 1/1959 | Anderson, Jr. | |
| 2,872,036 | A | | 2/1959 | Forrer | |
| 2,874,869 | A | | 2/1959 | Hennessey | |
| 2,922,561 | A | | 1/1960 | Currivan | |
| 2,928,541 | A | | 3/1960 | Fielding | |
| 2,955,739 | A | | 10/1960 | Collura | |
| 3,112,856 | A | | 12/1963 | MacIntosh et al. | |
| 3,127,720 | A | | 4/1964 | Gentry et al. | |
| 3,178,242 | A | | 4/1965 | Ellis | |
| 3,204,815 | A | | 9/1965 | Weiss | |
| 3,257,066 | A | | 6/1966 | Williams | |
| 3,269,531 | A | | 8/1966 | Weiss | |
| 3,300,115 | A | | 1/1967 | Schauer | |
| 3,306,519 | A | | 2/1967 | Wood | |
| 3,309,005 | A | | 3/1967 | Pilger | |
| 3,334,767 | A | | 8/1967 | Cornelius et al. | |
| 3,339,723 | A | | 9/1967 | Wood | |
| 3,353,709 | A | | 11/1967 | Lawrence | |
| 3,355,012 | A | | 11/1967 | Weiss | |
| 3,356,279 | A | | 12/1967 | Root | |
| 3,371,846 | A | | 3/1968 | Detzel | |
| 3,373,867 | A | | 3/1968 | Wood | |
| 3,381,881 | A | | 5/1968 | Granz et al. | |
| 3,554,402 | A | | 1/1971 | Lock | |
| 3,593,849 | A | | 7/1971 | Helms | |
| 3,635,452 | A | | 1/1972 | Helms | |
| 3,669,342 | A | | 6/1972 | Funkhouse | |
| 3,747,835 | A | | 7/1973 | Graser | |
| 3,767,042 | A | | 10/1973 | Ganz | |
| 3,828,926 | A | | 8/1974 | Rossi | |
| 3,886,901 | A | | 6/1975 | Zeitler | |
| 3,904,036 | A | | 9/1975 | Forrer | |
| 3,933,303 | A | | 1/1976 | Kirby, Jr. | |
| 3,963,121 | A | | 6/1976 | Kipp | |
| 3,994,432 | A | | 11/1976 | Kirby, Jr. | |
| 4,010,593 | A | | 3/1977 | Graham | |
| 4,029,204 | A | | 6/1977 | Manizza | |
| 4,034,852 | A | | 7/1977 | Forrer | |
| 4,036,423 | A | | 7/1977 | Gordon | |
| 4,096,985 | A | | 6/1978 | Wood | |
| 4,101,069 | A | | 7/1978 | Wood | |
| 4,111,306 | A | | 9/1978 | Roccaforte | |
| 4,202,446 | A | | 5/1980 | Sutherland | |
| 4,216,861 | A | | 8/1980 | Oliff | |
| 4,222,485 | A | | 9/1980 | Focke | |
| 4,295,562 | A | | 10/1981 | Wood | |
| 4,314,634 | A | * | 2/1982 | Stone | 206/167 |
| 4,318,474 | A | | 3/1982 | Hasegawa | |
| 4,327,829 | A | | 5/1982 | Hughes | |
| 4,328,893 | A | | 5/1982 | Oliff | |
| 4,328,923 | A | | 5/1982 | Graser | |
| 4,329,923 | A | | 5/1982 | Iida | |
| 4,331,289 | A | | 5/1982 | Killy | |
| 4,339,070 | A | | 7/1982 | Davies | |
| 4,364,509 | A | | 12/1982 | Holley, Jr. | |
| 4,375,258 | A | | 3/1983 | Crayne | |
| 4,378,905 | A | | 4/1983 | Roccaforte | |
| 4,382,505 | A | | 5/1983 | Sutherland | |
| 4,394,903 | A | | 7/1983 | Bakx | |
| 4,405,078 | A | | 9/1983 | Dutcher | |
| 4,424,901 | A | | 1/1984 | Lanier | |
| 4,440,340 | A | | 4/1984 | Bakx | |
| 4,470,503 | A | | 9/1984 | Stone | |
| 4,478,334 | A | | 10/1984 | Graser | |
| 4,498,619 | A | | 2/1985 | Roccaforte | |
| 4,508,258 | A | | 4/1985 | Graser | |
| 4,533,047 | A | | 8/1985 | Calvert | |
| 4,538,759 | A | | 9/1985 | Dutcher | |
| 4,545,485 | A | * | 10/1985 | Oliff | 206/434 |
| 4,546,914 | A | | 10/1985 | Roccaforte | |
| 4,558,816 | A | | 12/1985 | Wood | |
| 4,566,593 | A | | 1/1986 | Muller | |
| 4,577,799 | A | | 3/1986 | Oliff | |
| 4,582,199 | A | | 4/1986 | Schuster | |
| 4,588,084 | A | | 5/1986 | Holley, Jr. | |
| 4,637,515 | A | | 1/1987 | Wilson | |
| 4,653,686 | A | | 3/1987 | Wood | |
| 4,681,217 | A | * | 7/1987 | Hernandez | 206/141 |
| 4,681,252 | A | | 7/1987 | Doerr | |
| 4,684,059 | A | | 8/1987 | Rusnock | |
| 4,706,876 | A | | 11/1987 | Wilson | |
| 4,728,025 | A | | 3/1988 | Oliff | |
| 4,728,026 | A | | 3/1988 | Schuster | |
| 4,747,487 | A | | 5/1988 | Wood | |
| 4,747,534 | A | | 5/1988 | Marie | |
| 4,784,266 | A | | 11/1988 | Chaussadas | |
| 4,784,316 | A | | 11/1988 | Crouch | |
| 4,785,991 | A | | 11/1988 | Schuster | |
| 4,802,583 | A | | 2/1989 | Calvert | |
| 4,804,089 | A | | 2/1989 | Wilson | |
| 4,811,894 | A | | 3/1989 | Schuster | |
| 4,830,267 | A | | 5/1989 | Wilson | |
| 4,838,479 | A | | 6/1989 | Wood | |
| 4,875,585 | A | | 10/1989 | Kadleck | |
| 4,875,586 | A | | 10/1989 | Chaussadas | |
| RE33,110 | E | | 11/1989 | Wood | |
| 4,901,849 | A | | 2/1990 | Wilson | |
| 4,919,266 | A | | 4/1990 | McIntosh, Jr. | |
| 4,958,734 | A | | 9/1990 | Wood | |
| 4,966,324 | A | | 10/1990 | Steel | |
| 4,972,991 | A | | 11/1990 | Schuster | |
| 4,974,771 | A | | 12/1990 | Lavery | |
| 4,981,253 | A | | 1/1991 | Quaintance | |
| 5,000,313 | A | * | 3/1991 | Oliff | 206/140 |
| 5,002,186 | A | | 3/1991 | Cooper | |
| 5,020,337 | A | | 6/1991 | Krieg | |
| 5,042,660 | A | | 8/1991 | Carver | |
| 5,060,792 | A | | 10/1991 | Oliff | |
| 5,072,876 | A | | 12/1991 | Wilson | |
| 5,094,359 | A | | 3/1992 | DeMars | |
| 5,106,014 | A | | 4/1992 | Miller | |
| 5,108,030 | A | | 4/1992 | Schuster | |
| 5,119,985 | A | | 6/1992 | Dawson | |
| 5,131,588 | A | | 7/1992 | Oliff | |
| 5,180,100 | A | | 1/1993 | Shimizu | |
| 5,195,676 | A | | 3/1993 | LeBras | |
| 5,197,598 | A | | 3/1993 | Stout | |
| 5,221,041 | A | | 6/1993 | Stout | |
| 5,222,658 | A | | 6/1993 | DeMaio | |
| 5,234,102 | A | | 8/1993 | Schuster | |
| 5,246,112 | A | | 9/1993 | Stout | |
| 5,284,294 | A | | 2/1994 | Floyd | |
| 5,292,058 | A | | 3/1994 | Zoss | |
| 5,292,059 | A | | 3/1994 | Oliff | |
| 5,297,673 | A | | 3/1994 | Sutherland | |
| 5,297,725 | A | | 3/1994 | Sutherland | |
| 5,303,863 | A | | 4/1994 | Arasim | |
| 5,307,932 | A | | 5/1994 | Stout | |
| 5,307,986 | A | | 5/1994 | Schuster | |
| 5,320,277 | A | | 6/1994 | Stout | |
| 5,333,734 | A | | 8/1994 | Stout | |
| D350,480 | S | | 9/1994 | Sutherland | |
| 5,351,878 | A | * | 10/1994 | Cooper | 206/427 |
| 5,379,944 | A | | 1/1995 | Stout | |
| 5,381,891 | A | | 1/1995 | Harris | |
| 5,385,234 | A | | 1/1995 | Stout | |
| 5,395,044 | A | | 3/1995 | Stout | |
| 5,421,458 | A | | 6/1995 | Campbell | |

(56) References Cited

U.S. PATENT DOCUMENTS

| | | | | |
|---|---|---|---|---|
| 5,427,241 | A | 6/1995 | Sutherland | |
| 5,458,234 | A | 10/1995 | Harris | |
| 5,472,090 | A | 12/1995 | Sutherland | |
| 5,472,138 | A | 12/1995 | Ingram | |
| 5,480,091 | A | 1/1996 | Stout | |
| 5,482,203 | A | 1/1996 | Stout | |
| 5,485,915 | A * | 1/1996 | Harris | 206/147 |
| 5,495,727 | A | 3/1996 | Strong | |
| 5,505,372 | A | 4/1996 | Edson | |
| 5,524,756 | A | 6/1996 | Sutherland | |
| 5,542,536 | A | 8/1996 | Sutherland | |
| 5,549,197 | A | 8/1996 | Sutherland | |
| 5,551,556 | A | 9/1996 | Sutherland | |
| 5,558,212 | A | 9/1996 | Sutherland | |
| 5,558,213 | A | 9/1996 | Sutherland | |
| 5,582,343 | A | 12/1996 | Dalvey | |
| 5,593,027 | A | 1/1997 | Sutherland | |
| 5,595,291 | A | 1/1997 | Negelen | |
| 5,597,071 | A | 1/1997 | Sutherland | |
| 5,609,251 | A | 3/1997 | Harris | |
| 5,639,017 | A | 6/1997 | Fogle | |
| 5,647,483 | A | 7/1997 | Harris | |
| 5,664,401 | A | 9/1997 | Portrait | |
| 5,669,500 | A | 9/1997 | Sutherland | |
| 5,682,995 | A | 11/1997 | Sutherland | |
| 5,692,614 | A | 12/1997 | Harris | |
| 5,699,957 | A | 12/1997 | Blin | |
| 5,704,470 | A | 1/1998 | Sutherland | |
| 5,738,273 | A | 4/1998 | Auclair | |
| 5,778,630 | A | 7/1998 | Portrait | |
| 5,794,778 | A * | 8/1998 | Harris | 206/428 |
| 5,796,778 | A | 8/1998 | Kurker | |
| 5,819,920 | A | 10/1998 | Sutherland | |
| 5,826,782 | A | 10/1998 | Stout | |
| 5,826,783 | A | 10/1998 | Stout | |
| 5,853,088 | A | 12/1998 | Saulas | |
| 5,855,318 | A | 1/1999 | Baxter | |
| 5,873,515 | A | 2/1999 | Dunn | |
| 5,878,946 | A | 3/1999 | Frerot | |
| 5,906,313 | A | 5/1999 | Oliff | |
| 5,915,546 | A | 6/1999 | Harrelson | |
| 5,931,300 | A | 8/1999 | Sutherland | |
| 5,937,620 | A | 8/1999 | Chalendar | |
| 5,941,453 | A | 8/1999 | Oliff | |
| 5,947,367 | A | 9/1999 | Miller | |
| 5,975,286 | A | 11/1999 | Oliff | |
| 5,992,733 | A | 11/1999 | Gomes | |
| 5,996,883 | A | 12/1999 | Bates | |
| 6,019,220 | A | 2/2000 | Sutherland | |
| 6,019,276 | A | 2/2000 | Auclair | |
| 6,021,898 | A | 2/2000 | Sutherland | |
| 6,021,899 | A | 2/2000 | Sutherland | |
| 6,065,590 | A | 5/2000 | Spivey | |
| 6,105,853 | A | 8/2000 | Lamare | |
| 6,105,854 | A | 8/2000 | Spivey | |
| 6,109,438 | A | 8/2000 | Sutherland | |
| 6,126,066 | A | 10/2000 | Peterson | |
| 6,129,266 | A | 10/2000 | Oliff | |
| 6,131,803 | A | 10/2000 | Oliff | |
| 6,155,480 | A | 12/2000 | Botsford | |
| 6,158,586 | A * | 12/2000 | Muller | 206/427 |
| 6,164,526 | A | 12/2000 | Dalvey | |
| 6,170,741 | B1 | 1/2001 | Skolik | |
| 6,227,367 | B1 | 5/2001 | Harrelson | |
| 6,237,839 | B1 | 5/2001 | Brown | |
| 6,250,542 | B1 | 6/2001 | Negelen | |
| 6,260,755 | B1 | 7/2001 | Bates | |
| 6,273,330 | B1 | 8/2001 | Oliff | |
| 6,289,651 | B1 | 9/2001 | LeBras | |
| 6,302,320 | B1 | 10/2001 | Stout | |
| 6,315,123 | B1 | 11/2001 | Ikeda | |
| 6,425,520 | B1 | 7/2002 | Peterson | |
| 6,484,903 | B2 | 11/2002 | Spivey | |
| 6,523,739 | B2 | 2/2003 | Heeley | |
| 6,536,656 | B2 | 3/2003 | Auclair | |
| 6,550,616 | B2 | 4/2003 | LeBras | |
| 6,631,803 | B2 | 10/2003 | Rhodes | |
| 6,695,137 | B2 | 2/2004 | Jones | |
| 6,758,337 | B2 | 7/2004 | Chargueraud | |
| 6,766,940 | B2 | 7/2004 | Negelen | |
| 6,811,525 | B2 | 11/2004 | Culpepper | |
| 6,848,573 | B2 | 2/2005 | Gould | |
| 6,866,185 | B2 | 3/2005 | Harrelson | |
| 6,896,130 | B2 | 5/2005 | Theelen | |
| 6,905,066 | B2 | 6/2005 | Holley, Jr. | |
| 6,926,193 | B2 | 8/2005 | Smalley | |
| 6,942,140 | B2 | 9/2005 | Merzeau | |
| 6,948,651 | B2 | 9/2005 | Ikeda | |
| 6,968,992 | B2 | 11/2005 | Schuster | |
| 6,981,631 | B2 | 1/2006 | Fogle | |
| 6,988,617 | B2 | 1/2006 | Gomes | |
| 7,007,800 | B2 | 3/2006 | LeBras | |
| 7,007,836 | B2 | 3/2006 | Smalley | |
| 7,159,759 | B2 | 1/2007 | Sutherland | |
| 7,273,161 | B2 | 9/2007 | Fogle | |
| 7,427,010 | B2 | 9/2008 | Sutherland | |
| 7,448,492 | B2 | 11/2008 | Sutherland | |
| 7,472,791 | B2 | 1/2009 | Spivey, Sr. | |
| 7,743,968 | B2 | 6/2010 | Theelen | |
| 7,748,603 | B2 | 7/2010 | Fogle | |
| 7,757,933 | B2 | 7/2010 | Dunn | |
| 7,762,397 | B2 | 7/2010 | Coltri-Johnson | |
| 7,793,779 | B2 | 9/2010 | Spivey, Sr. | |
| 7,806,314 | B2 | 10/2010 | Sutherland | |
| 2003/0000182 | A1 | 1/2003 | Portrait et al. | |
| 2003/0132130 | A1 | 7/2003 | Bras | |
| 2003/0213263 | A1 | 11/2003 | Woog | |
| 2004/0011674 | A1 | 1/2004 | Theelen | |
| 2004/0074854 | A1 | 4/2004 | Lin | |
| 2004/0089671 | A1 | 5/2004 | Miller | |
| 2004/0188277 | A1 | 9/2004 | Auclair | |
| 2004/0188301 | A1 | 9/2004 | Gomes | |
| 2004/0243277 | A1 | 12/2004 | Bonnain et al. | |
| 2004/0254666 | A1 | 12/2004 | Bonnain et al. | |
| 2005/0001020 | A1 | 1/2005 | Garner | |
| 2005/0056658 | A1 | 3/2005 | Spivey | |
| 2005/0167478 | A1 | 8/2005 | Holley | |
| 2005/0178791 | A1 | 8/2005 | Miller | |
| 2005/0194430 | A1 | 9/2005 | Auclair et al. | |
| 2006/0169755 | A1 | 8/2006 | Spivey | |
| 2006/0191811 | A1 | 8/2006 | Fogle et al. | |
| 2006/0255108 | A1 | 11/2006 | Shmagin | |
| 2006/0273143 | A1 | 12/2006 | Finch | |
| 2007/0017962 | A1 | 1/2007 | Russ | |
| 2007/0029371 | A1 * | 2/2007 | Theelen | 229/117.13 |
| 2007/0039846 | A1 | 2/2007 | Spivey | |
| 2007/0051781 | A1 | 3/2007 | Holley | |
| 2007/0108261 | A1 | 5/2007 | Schuster | |
| 2007/0164091 | A1 | 7/2007 | Fogle | |
| 2007/0181658 | A1 | 8/2007 | Sutherland | |
| 2007/0205255 | A1 | 9/2007 | Dunn | |
| 2007/0295789 | A1 | 12/2007 | Ho Fung | |
| 2008/0067223 | A1 | 3/2008 | Jego | |
| 2008/0073420 | A1 | 3/2008 | Walling | |
| 2009/0236408 | A1 | 9/2009 | Spivey | |
| 2010/0213249 | A1 | 8/2010 | Requena | |
| 2011/0036902 | A1 | 2/2011 | Smalley | |

FOREIGN PATENT DOCUMENTS

| | | | |
|---|---|---|---|
| CA | 1 243 987 | A1 | 11/1988 |
| CA | 2160145 | | 9/1995 |
| DE | 85147184 | | 6/1985 |
| DE | 91049059 | | 6/1991 |
| DE | 92038581 | | 5/1992 |
| DE | 29607374 | U1 | 4/1996 |
| DE | 20112228 | U1 | 11/2002 |
| DE | 2004018649 | | 4/2005 |
| EP | 0473266 | | 3/1992 |
| EP | 0509749 | A1 | 10/1992 |
| EP | 0459658 | A1 | 12/1992 |
| EP | 0520411 | A1 | 12/1992 |
| EP | 1612157 | | 1/2006 |
| EP | 2 149 506 | A1 | 2/2010 |

(56) References Cited

FOREIGN PATENT DOCUMENTS

| | | | |
|---|---|---|---|
| FR | 1438035 | | 1/1965 |
| FR | 2698074 | | 5/1994 |
| GB | 1101345 | | 1/1968 |
| GB | 2202825 | | 10/1988 |
| GB | 2209515 | | 5/1989 |
| JP | 5-112373 | | 5/1993 |
| JP | 7-11566 | | 2/1995 |
| JP | H08-2551 | A | 1/1996 |
| JP | 10-338266 | | 12/1998 |
| JP | 2003-200967 | | 7/2003 |
| JP | 2004-53378 | | 11/2004 |
| WO | 9627538 | | 9/1996 |
| WO | 9727124 | | 7/1997 |
| WO | WO 98/09871 | A2 | 3/1998 |
| WO | 9928207 | | 6/1999 |
| WO | 0078618 | A1 | 12/2000 |
| WO | 0166434 | A1 | 9/2001 |
| WO | 02102208 | A1 | 12/2002 |
| WO | 03008292 | A2 | 1/2003 |
| WO | WO 03/004377 | A1 | 1/2003 |
| WO | 03037742 | A2 | 5/2003 |
| WO | 2005042370 | A1 | 5/2005 |
| WO | 2005080218 | | 9/2005 |
| WO | 2005123532 | | 12/2005 |
| WO | 2007089282 | | 8/2007 |
| WO | 2009117562 | | 9/2009 |
| WO | WO 2011/022378 | A2 | 2/2011 |

OTHER PUBLICATIONS

Supplementary European Search Report for EP 11 83 4897 dated Mar. 27, 2014.

Notification of Reason for Refusal for JP Application No. 2013-534968 dated May 28, 2015, with English translation.

* cited by examiner

CARTON WITH HANDLE

CROSS-REFERENCE TOP RELATED APPLICATION

This application claims the benefit of U.S. Provisional Patent Application No. 61/455,269, filed Oct. 18, 2010.

INCORPORATION BY REFERENCE

The disclosure of U.S. Provisional Patent Application No. 61/455,269, which was filed on Oct. 18, 2010, is hereby incorporated by reference for all purposes as if presented herein in its entirety.

BACKGROUND OF THE DISCLOSURE

The present disclosure generally relates to cartons for holding and carrying beverage containers or other types of articles.

SUMMARY OF THE DISCLOSURE

In one aspect, the disclosure is generally directed to a carton for carrying a plurality of articles. The carton comprises a bottom panel, a first side panel foldably connected to the bottom panel, a second side panel foldably connected to the bottom panel, and at least one top panel foldably connected to at least one of the first side panel and the second side panel, the at least one top panel comprises a handle for grasping and carrying the carton, the handle comprises at least one handle feature for forming a handle opening in the top panel, the at least one handle feature having a width less than a width of the at least one top panel.

In one aspect, the disclosure is generally directed to a carton for carrying a plurality of articles. The carton comprises at least one bottom panel, a first side panel foldably connected to at least one bottom panel, a second side panel foldably connected to the at least one bottom panel, and a top panel foldably connected to at least one of the first side panel and the second side panel. A handle is for grasping and carrying the carton. The handle comprises at least one handle flap foldably connected to the top panel at a fold line. The at least one handle flap has a first width corresponding to a maximum width of the last least one handle flap. The top panel has a second width corresponding to a minimum distance between a first edge and a second edge of the top panel. The first width is less than the second width. A first line of weakening is in the top panel that extends from a first end of the fold line to the first edge of the top panel. A second line of weakening is in the top panel that extends from a second end of the fold line to the second edge of the top panel.

In another aspect, the disclosure is generally directed to a blank for forming a carton for carrying a plurality of articles. The blank comprises at least one bottom panel, a first side panel foldably connected to the at least one bottom panel, a second side panel foldably connected to the at least one bottom panel, and at least one top panel foldably connected to at least one of the first side panel and the second side panel. The blank comprises handle features for forming a handle for grasping and carrying the carton formed from the blank. The handle features comprise at least one handle flap foldably connected to the top panel at a first fold line. The at least one handle flap has a first width corresponding to a maximum width of the last least one handle flap. The at least one top panel has a second width corresponding to a minimum distance between a first edge and a second edge of the at least one top panel. The first width is less than the second width. A first line of weakening in the top panel extends from a first end of the first fold line to the first edge of the at least one top panel. A second line of weakening in the top panel extends from a second end of the second fold line to the second edge of the at least one top panel.

In another aspect, the disclosure is generally directed to a method of forming a carton from a blank.

In another aspect, the disclosure is generally directed to a method of carrying a carton.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons or carriers that contain articles such as containers, bottles, cans, etc. The articles can be used for packaging food and beverage products, for example. The articles can be made from materials suitable in composition for packaging the particular food or beverage item, and the materials include, but are not limited to, glass and/or other metals; aluminum; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., glass beverage bottles B having caps C) as disposed within the carton embodiments. In this specification, the terms "lower," "bottom," "upper" and "top" indicate orientations determined in relation to fully erected and upright cartons.

Figure 1A:
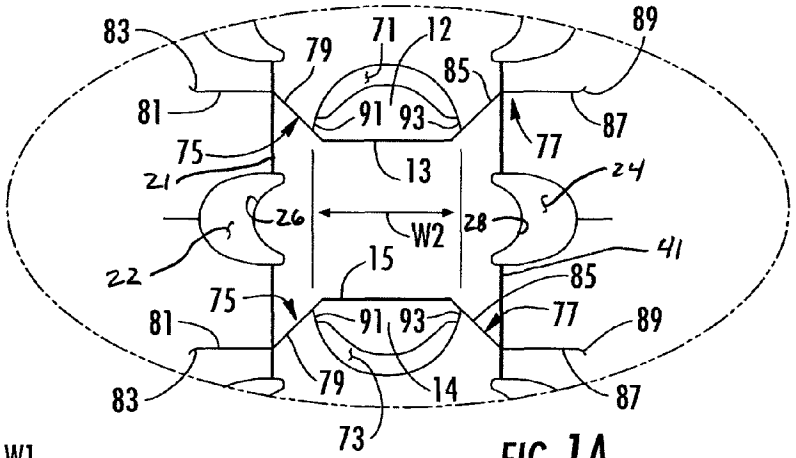
FIG. 1A is an enlarged portion of FIG. 1.
Figure 1:
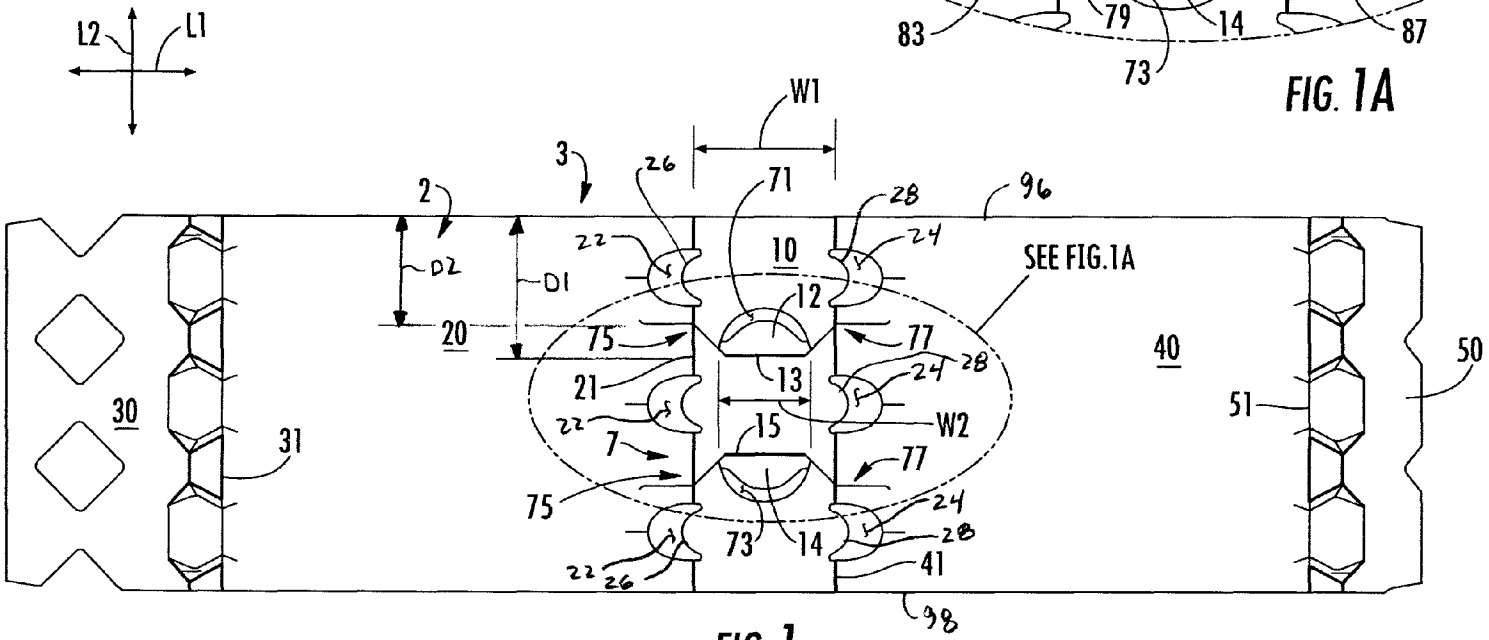
FIG. 1 is a plan view of an exterior surface of a blank used to form a carton according to a first embodiment of the disclosure.
Figure 2:
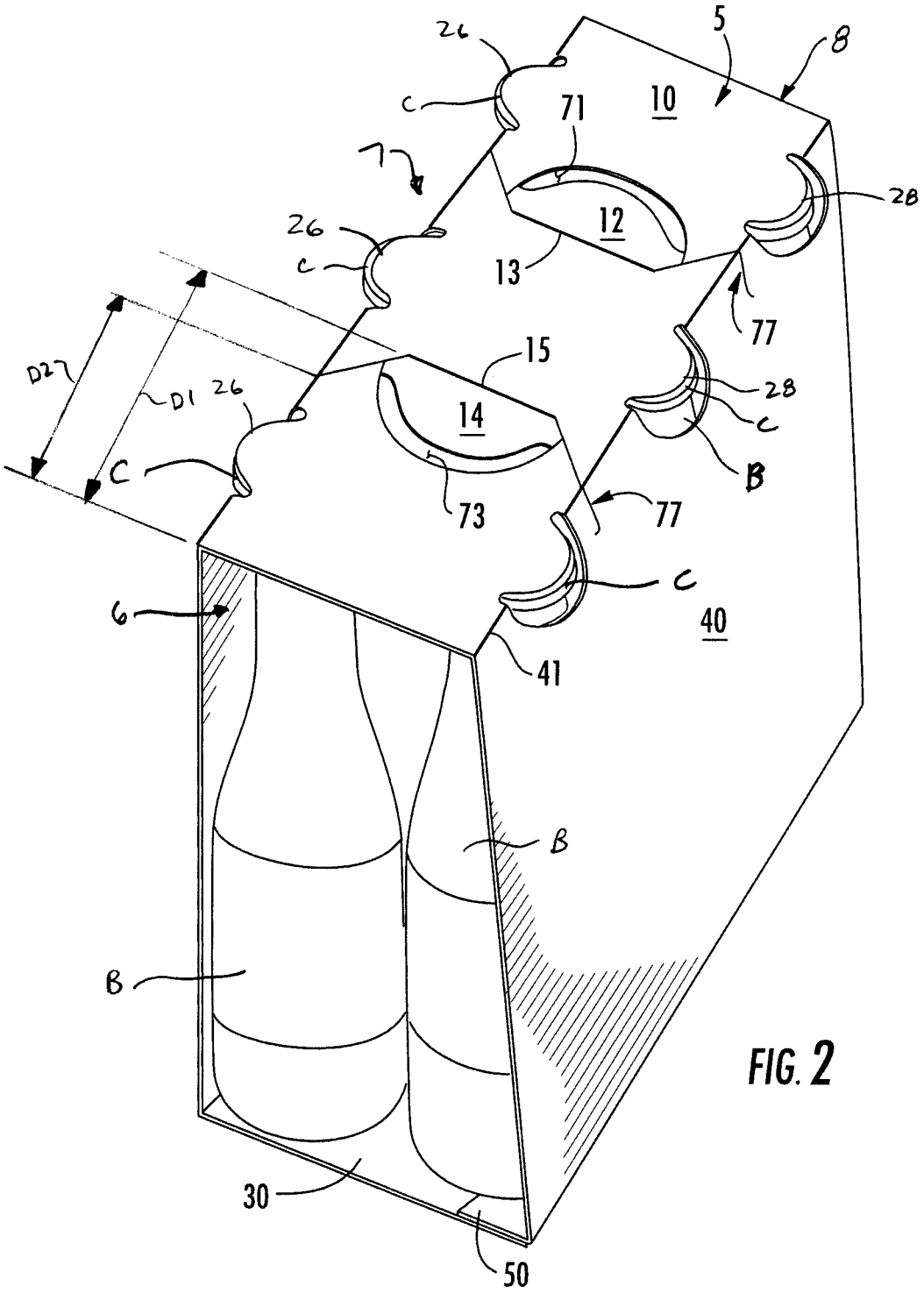
FIG. 2 is an end perspective view of a carton of the first embodiment.

FIG. 1 is a plan view of an exterior surface 2 of a blank 3, used to form a carton 5 (FIG. 2) according to a first embodiment of the disclosure. The carton 5 can be used to house a plurality of articles such as containers B (FIG. 2). In the first embodiment, the containers B are beverage bottles and the carton 5 is sized to house six containers in a single layer in a 2×3 arrangement. But, it is understood that the carton 5 may be sized and shaped to hold containers B of a different or same quantity in more than one layer and/or in different row/column arrangements (e.g., 1×6, 2×6, 2×4, 2×2, 2×6×2, 2×4×2, 2×9, etc.). In the illustrated embodiment, the carton 5 is a carrier having generally open ends 6, 8 (FIG. 4) that wraps around the containers B (e.g., the carton 5 may be referred to as a wrap-around carton). The carton 5 could be otherwise shaped and arranged such the ends 6, 8 are at least partially closed such as by end flaps (not shown) or other closing mechanisms.

The blank 3 has a longitudinal axis L1 and a lateral axis L2. In the first embodiment, the blank 3 comprises a top panel 10 foldably connected to a first side panel 20 at a first lateral fold line 21, a first bottom panel 30 foldably connected to the first side panel 20 at a second lateral fold line 31, a second side panel 40 foldably connected to the top panel 10 at a third lateral fold line 41, and a second bottom panel 50 foldably connected to the second side panel 40 at a fourth lateral fold line 51. In the illustrated embodiment, the blank 3 comprises three openings 22 that separate portions of the lateral fold line 21 and three openings 24 that separate portions of the lateral fold line 41. Each of the openings 22 has a respective curved edge 26 that cooperates with the lateral fold line 21 to form a first edge of top panel 10. Each of the openings 24 has a respective curved edge 28 that cooperates with the lateral fold line 41 to from a second edge of the top panel 10.

As shown in FIGS. 1 and 1A, the blank 3 includes handle features for forming a handle 7 in the carton 5. In one embodiment, the handle features include a first handle flap 12 and a second handle flap 14, each respectively foldably attached to the top panel 10 at respective longitudinal fold lines 13, 15. In the illustrated embodiment, the handle features include arcuate cutouts 71, 73 adjacent a respective handle flap 12, 14 in the top panel 10. The handle features comprise a first tear line 75 (broadly "first line of weakening") extending from a first end of the lateral fold line 13 and a second tear line 77 (broadly "second line of weakening") extending from a second end of the lateral fold line 13. Similarly, the handle features comprise a third tear line 75 (broadly "third line of weakening") that is a mirror image of the first tear line 75 and extends from a first end of the lateral fold line 15, and a fourth tear line 77 (broadly "fourth line of weakening") that is a mirror image of the second tear line 77 and extends from a second end of the lateral fold line 15. In one embodiment, each of the tear lines 75 have a first portion 79 in the top panel 10 extending from the first end of respective longitudinal fold lines 13, 15 to the lateral fold line 21, and a second portion 81 extending from the first portion and terminating at a J-shaped cut 83 in the first side panel 20. As shown in FIGS. 1 and 1A, the first portion 79 is generally oblique relative to the fold line 13, 15 and the lateral fold line 21 forming the first edge of the top panel 10. In one embodiment, the second portion 81 extends in the longitudinal direction L1 of the blank 3 and is generally perpendicular to the lateral fold line 21. The tear lines 77 have a generally similar shape as the tear lines 75 and have a first portion 85 extending from the second end of respective longitudinal fold lines 13, 15 to the lateral fold line 41 and a second portion 87 extending from the first portion and terminating at a J-shaped cut 89 in the second side panel 40. In one embodiment, the first portion 85 is generally oblique relative to the fold line 13, and the fold line 41 forming the second edge of the top panel 10. In one embodiment, the second portion 87 extends in the longitudinal direction L1 of the blank 3 and is generally perpendicular to the lateral fold line 41. The handle flaps 12, 14 are further defined by respective cuts 91, 93 (FIG. 1A) extending from a respective cutout 71, 73 to a respective tear line 75, 77. The features forming the handle 7 could be otherwise shaped, arranged, and/or configured without departing from the disclosure.

In one embodiment, the top panel 10 has a width W1 corresponding to a minimum distance between the fold lines 21, 41 that form a respective first edge and second edge of the top panel. The handle panels 12, 14 have a maximum width W2 corresponding to the distance between the intersection of the cut 91 with the tear line 75 and the intersection of the cut 93 with the tear line 77. In one exemplary embodiment, the width W2 is less than the width W1. For example, in one embodiment, the width W1 of the top panel 10 can be at least approximately 68 mm and the width W2 of the handle panels 12, 14 can be at least about 47 mm so that the width W2 is at least approximately 70% of the width W1. Further, the width W2 can be at least approximately 30% less than the width W1. In other embodiments, the width W2 can be more than 30% less than the width W1 or the width W2 could be could be less than 70% of the width W1. In the illustrated embodiment, the handle flaps 12, 14 have a width W2 that allows less than an entire hand of a typical user (e.g., two or three fingers) to initiate folding of each of the handle flaps 12, 14. The above dimensions are exemplary of one embodiment and are not intended to limit the scope of the disclosure. The blank 3 could have other dimensions without departing from the scope of the disclosure.

In an exemplary embodiment, the fold line 13 connecting the handle flap 12 to the top panel is spaced apart from a longitudinally extending edge 96 of the blank 3, that corresponds with a first end 6 of the carton 5 formed from the blank, by a first distance D1, and the intersection of the tear lines 75, 77 with a respective lateral fold line 21, 41 is spaced apart from the edge 96 of the blank by a second distance D2. In one embodiment, the handle features are configured so that the first distance D1 is greater than the second distance D2 so that the second portions 81, 87 of the tear lines 75, 77 extend in the side panel at a location that is offset from where the handle flaps 12, 14 are grasped. In one embodiment, the distance D1 is approximately 64 mm and the distance D2 is approximately 48 mm, however, the distances D1, D2 could be greater than or less than listed herein without departing from the disclosure. Similarly, the fold line 15 is spaced apart from a longitudinally extending edge 98 of the blank 3, that corresponds with a second end 8 of the carton 5 formed from the blank, by the first distance D1, and the intersection of the tear lines 75, 77 extending from the fold line 15 with the respective lateral fold line 21, 41 is spaced apart from the edge 98 by the second distance D2.

Figure 3:
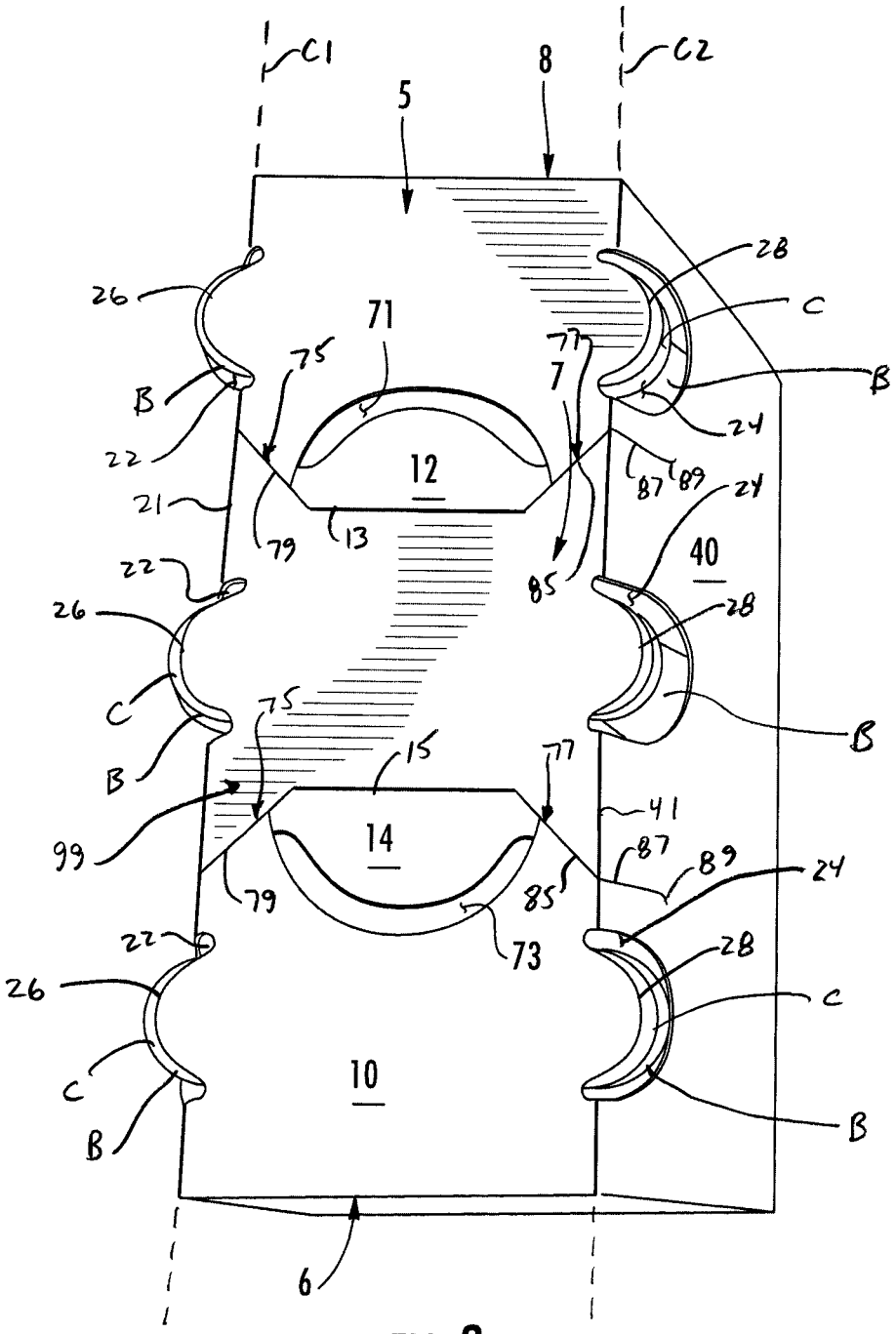
FIG. 3 is a top view of the carton of the first embodiment.

In an exemplary method of erecting the carton 5, the blank 3 can be lowered onto the tops or caps C of containers B, such that the top panel 10 contacts the tops of the containers. The containers B can be arranged in a group (e.g., in a 2×3 arrangement) and the top panel 10 is aligned with group of containers such that edges of the top panel 10 corresponding to the fold lines 21, 41 are aligned with respective centerlines C1, C2 (FIG. 3) of the first and second rows of containers. Also, as shown in FIG. 3, the edges 26, 28 of respective openings 22, 24 generally correspond to the shape of the caps C of the containers B. The edges 26, 28 form protrusions of the top panel 10 that overlap the tops C of the containers B. Portions of the bottles B are visible through and can protrude through the openings 22, 24 that are in the top panel 10 and the side panels 20, 40. The blank 3 can be wrapped tightly around the group of containers B to be packaged by downwardly folding the side panels 20, 40 relative to the top panel 10. The bottom panels 30, 50 can be at least partially overlapped and secured by adhesive or the bottom panels can have locking features for locking the panels without the use of adhesive.

Figure 4:
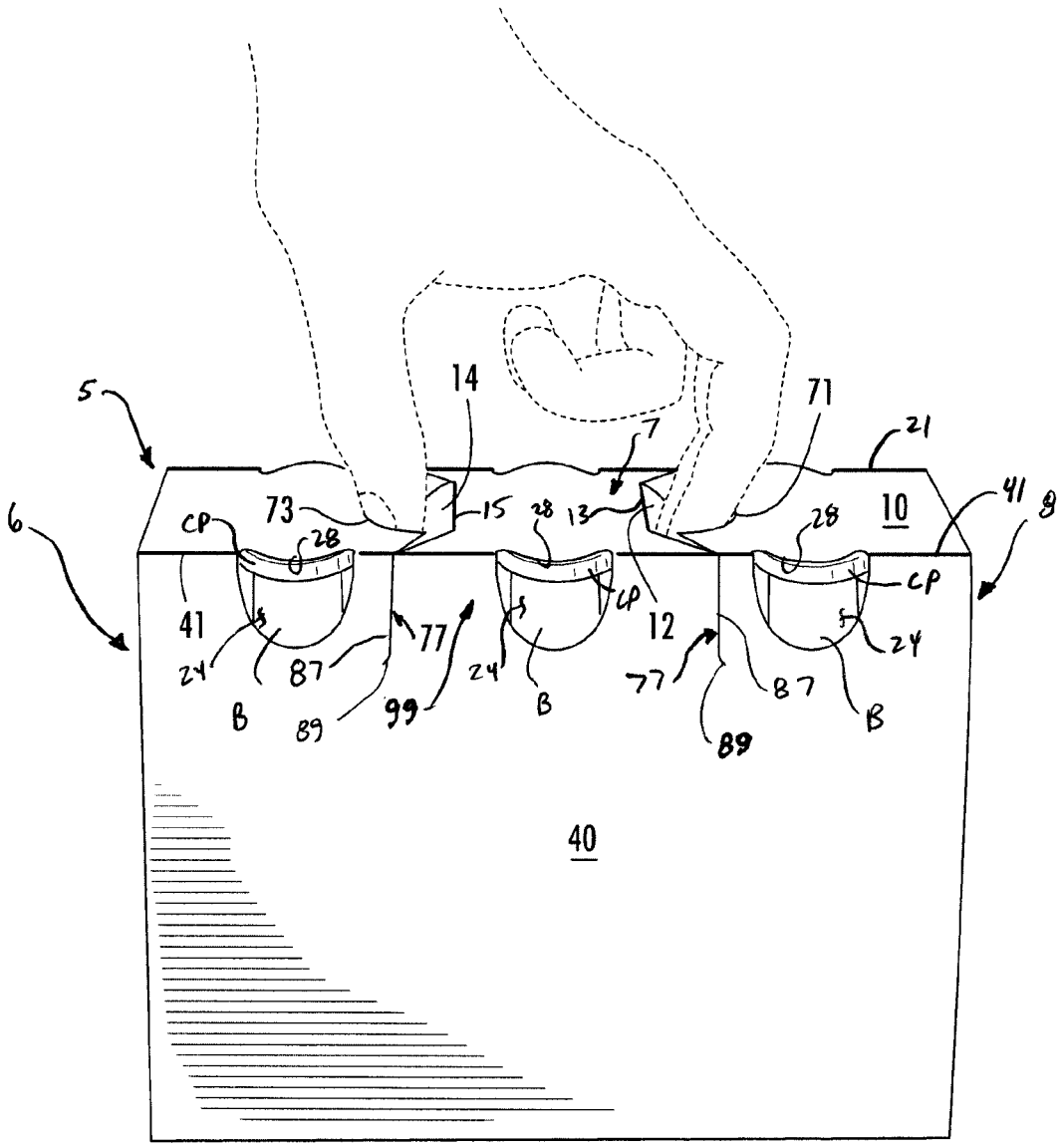
FIG. 4 is a side perspective view of the carton of the first embodiment being carried.
Figure 5:
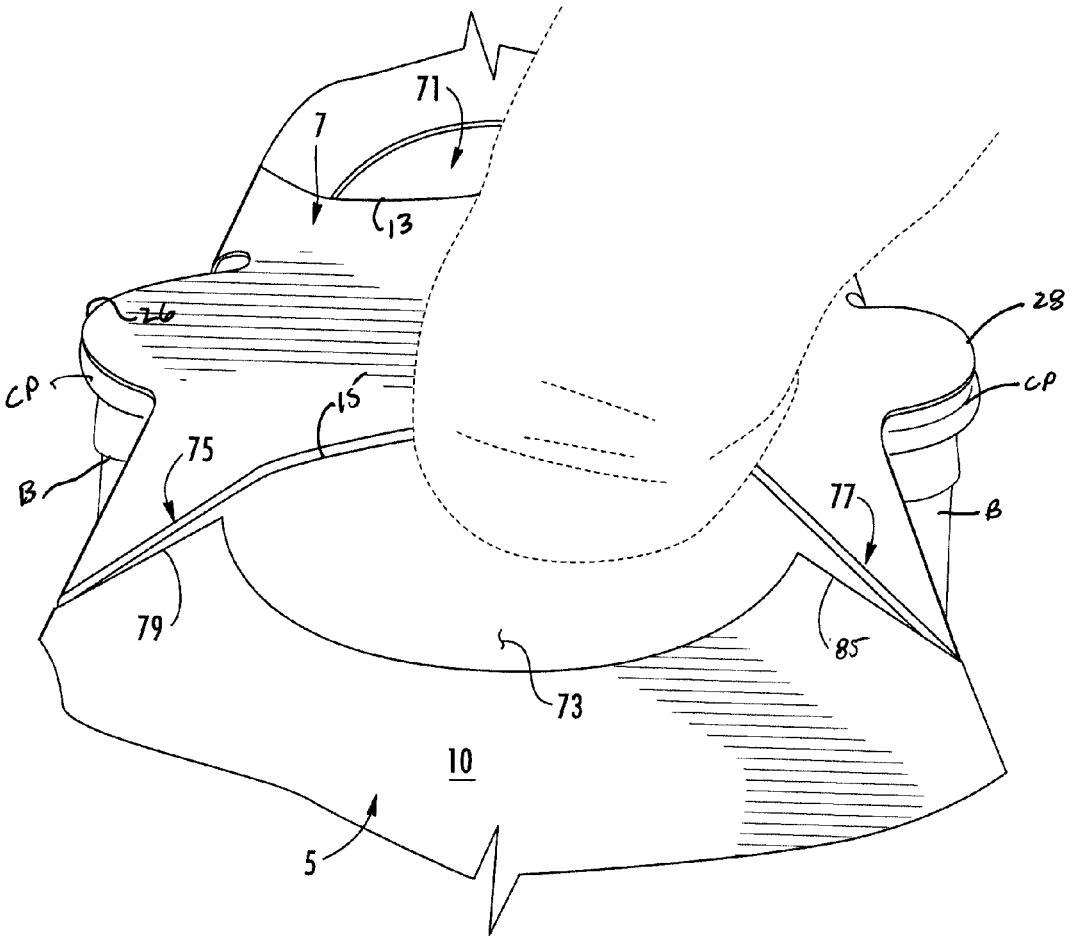
FIG. 5 is an enlarged detail view of FIG. 4.

As shown in FIGS. 4 and 5, the handle 7 is activated by folding the handle panels 12, 14 inwardly to expand the openings 71, 73. The carton 5 can be grasped at the handle 7 by the user inserting a thumb into one of the openings 71, 73 and the user inserting one or two fingers in the other of the openings 71, 73. When the handle 7 is activated and the carton 5 lifted, the tear lines 75, 77 are torn so that the tear lines 79, 85 in the top panel 10 are torn and the tear lines 81, 87 in the side panels 20, 40 are torn. The tear lines 75, 77 are arranged to prevent additional/uncontrolled tearing or weakening of the material of the carton 5 resulting in a handle 7 that is strengthened. The portion of the carton 5 between the fold lines 13 and tear lines 75, 77 extending therefrom, and the fold line 15 and the tear lines 75, 77 extending therefrom, forms a reinforced lifting portion 99 of the carton 5 that is strengthened by the configuration and controlled tearing of the features of the handle 7. In one embodiment, the lifting portion 99 comprises a portion of the top panel 10 and portions of the side panels 20, 40, but the lifting portion could be otherwise shaped, arranged, and/or configured without departing from the disclosure.

The handle panels 12, 14 are sized to limit the number of fingers a user can place through the top panel 10. Limiting the amount of fingers inserted into the handle 7 prevents the tendency for an entire hand to be inserted into the handle which can cause uncontrolled tearing of the carton 5 and weakening of the handle.

Figure 6:
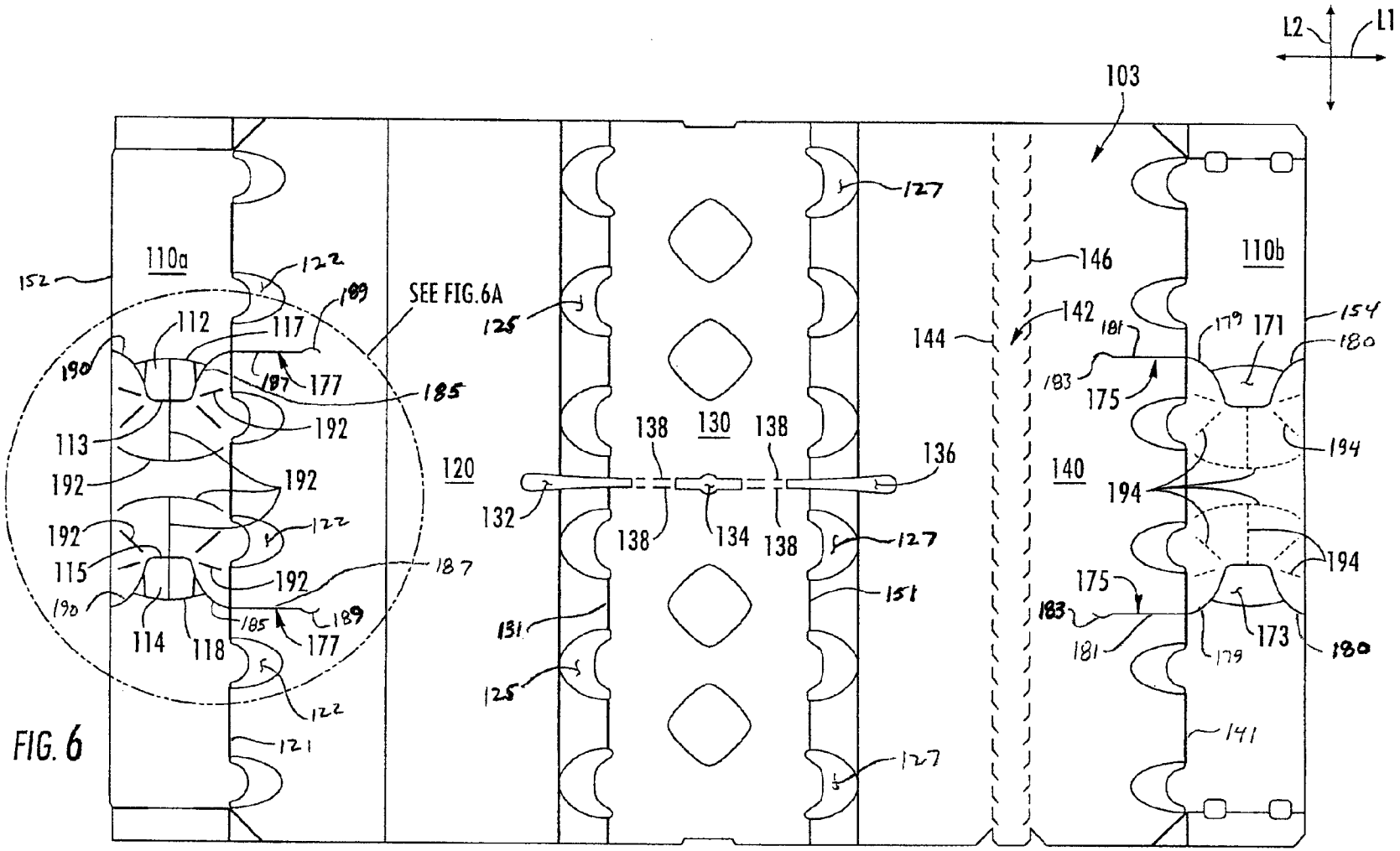
FIG. 6 is a plan view of an exterior surface of a blank used to form a carton according to a second embodiment of the disclosure.
Figure 6A:
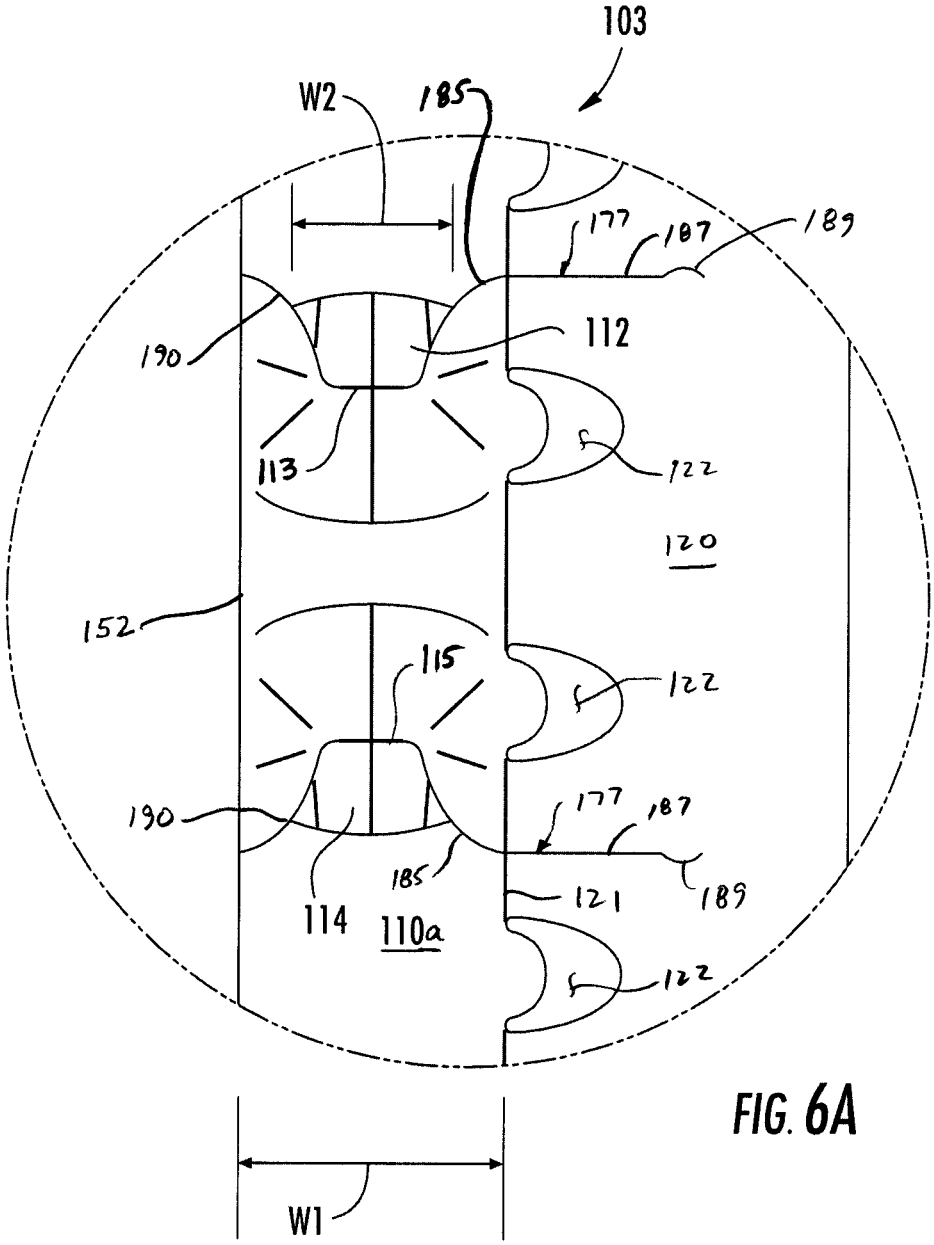
FIG. 6A is an enlarged portion of FIG. 6.
Figure 7:
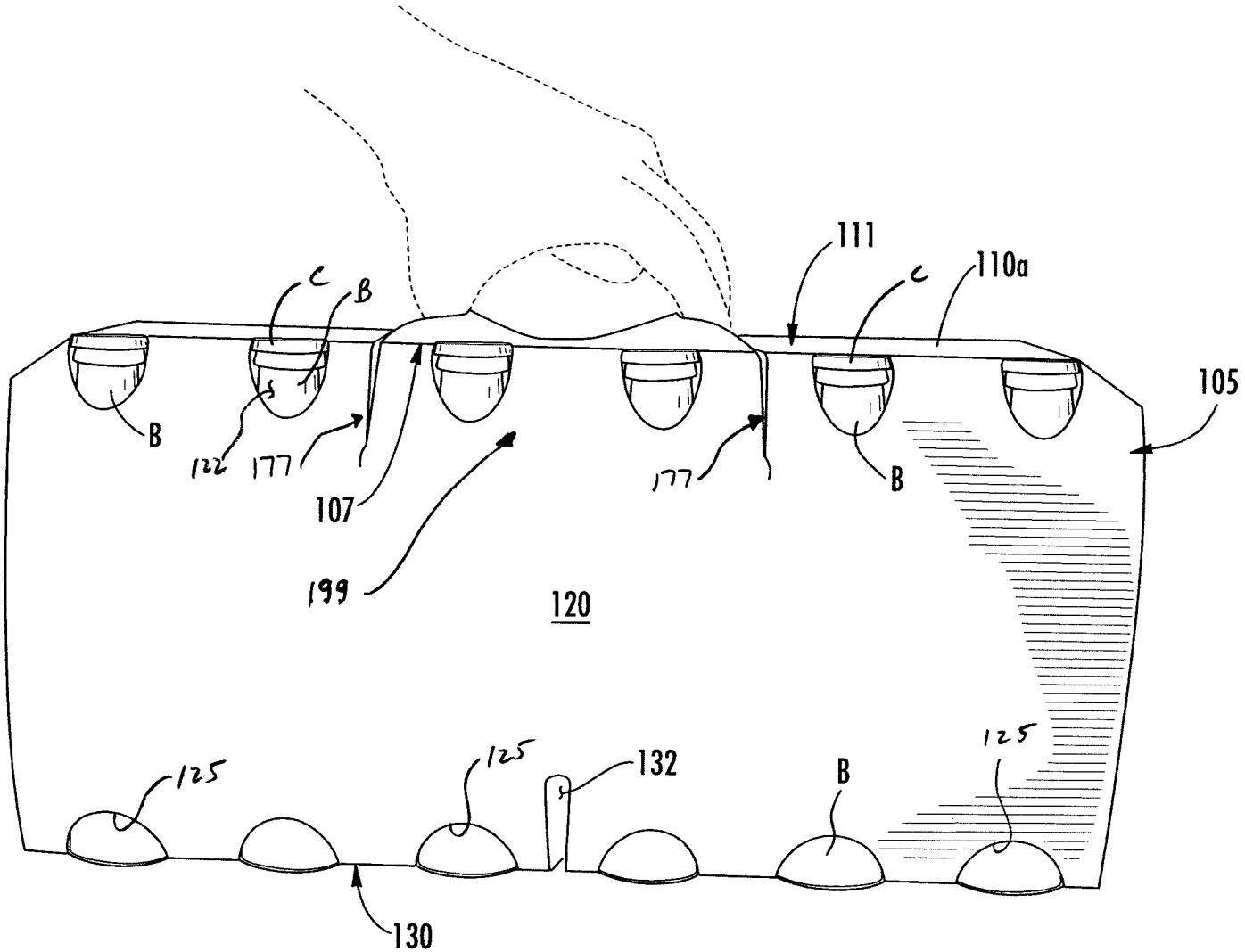
FIG. 7 is a side perspective view of the carton of the second embodiment being carried.

FIGS. 6-7 illustrate a blank 103 used to form a carton 105 (FIG. 7) according to a second embodiment of the present disclosure. The second embodiment is like the first embodiment shown and described with reference to FIGS. 1-5, except for variations noted and other variations that would be apparent to one of ordinary skill in the art. In FIGS. 6-7, like reference numbers as to the reference numbers shown in FIGS. 1-5 indicate like or similar elements, with the reference numbers in FIGS. 6-8 being preceded by "1." The blank 103 includes handle features for forming a handle 107 of the carton 105 that is similar to the handle 7 of the first embodiment. The carton 105 of the second embodiment includes two rows of six containers B arranged in a 2×6 arrangement, but the carton could have containers otherwise arranged (e.g., 1×6, 2×3, 2×4, 2×2, 2×6×2, 2×4×2, 2×9, etc.).

In the embodiments of FIGS. 6-7, the blank 103 includes a single bottom panel 130, a first side panel 120 foldably connected to the bottom panel at a lateral fold line 131, a second side panel 140 foldably connected to the bottom panel at a lateral fold line 151, a first top panel 110*a* foldably connected to the first side panel at a lateral fold line 121, and a second top panel 110*b* foldably connected to the second side panel 140 at a lateral fold line 141. The two top panels 110*a*, 110*b* of the blank 103 are overlapped to form the top panel 111 of the carton 105. In the second embodiment, the second side panel 140 has a dispensing feature 142 in the form of tear strip extending laterally across the blank 103 and formed by two spaced apart tear lines 144, 146. The bottom panel 130 and two side panels 120, 140 have weakening features in the form of a series of spaced apart openings 132, 134, 136 that facilitate lifting and carrying of the carton 105. Lines of weakening 138 extend between respective openings in the bottom panel 130. The lines of weakening 138 can be spaced apart cuts that form a tear feature, or the lines of weakening can be a fold line extending between respective openings 132, 134, 136.

In the second embodiment, the first top panel 110*a* includes the handle panels 112, 114 that are foldably connected to the top flap at fold lines 113, 115. The handle panels 112, 114 are separable from the top panel 110*a* by a respective tear line 117, 118. As with the first embodiment, the handle panels 112, 114 have a maximum width W2 that is less than the width W1 between respective edges of the top panel 110*a* and the top panel 111 formed by the overlapping arrangement of the top panels 110*a*, 110*b*. The dimensions noted above for the widths W1, W2 of the first embodiment can be the same or similar as the corresponding dimensions for the second embodiment.

In the second embodiment, the width W1 is the minimum distance between the lateral fold line 121 and a laterally extending edge 152 of the blank 103. The blank 103 of the second embodiment has openings 122, 124 in a respective side panel 120, 140 similar to the openings 22, 24 of the first embodiment. Also, the blank 103 has openings 125, 127 in a respective side panel 120, 140 for receiving a bottom portion of the containers B held in the carton 105.

The carton 105 is formed in a similar manner as the carton 5 of the previous embodiment. In one embodiment, the containers B are grouped into a 2×6 arrangement and are placed on the bottom panel 130 of the blank 103. The blank 103 is wrapped around the group of containers B so that the second top panel 110*b* contacts the tops or caps C of the containers B and the first top panel 110*a* overlaps the second top panel to form the top panel 111 of the carton 105. The first top panel 110*a* and second top panel 110*b* can be adhered together by glue or other adhesive, or the carton 105 can be secured by other mechanisms.

In the embodiment of FIGS. 6-7, the second top panel 110*b* has two handle openings 171, 173. When the top panels 110*a*, 110*b* are overlapped, the handle panels 112, 114 overlay the handle openings 171, 173 that are aligned to receive the handle panels when the handle 107 is activated. The handle features of the blank 103 include respective tear lines 177 extending from the ends of the fold lines 113, 115, in the first top panel 110*a* into the first side panel 120. The handle features of the blank 103 include respective tear lines 175 extending from the handle openings 171, 173 in the second top panel 110*b* and into the second side panel 140.

As with the first embodiment, the tear lines 175, 177 have features that allow controlled tearing when activating the handle 107 to strengthen the handle and prevent uncontrolled tearing. In the second embodiment, the tear lines 177 include a first portion 185 that is curved and extends from a respective end of the fold lines 113, 115 to the lateral fold line 121. A second portion 187 of the tear line 177 extends from the first portion 185 and terminates at a C-shaped cut 189 in the first side panel 120. In one embodiment, the first portion 185 is generally curved, and the second portion 187 extends in the longitudinal direction L1 of the blank 103 and is generally perpendicular to the lateral fold line 121. Similarly, the tear line 175 has a curved first portion 179 extending from the openings 171, 173 in the second top panel 110*b*, a second portion 181 that extends in the longitudinal direction L1 and is generally perpendicular to the lateral fold line 141. The second portion 181 terminates at a C-shaped cut 183 in the second side panel 140. In the second embodiment, the blank 103 has curved tear lines 190 extending from a respective second end of the fold lines 113, 115 in the first top panel 110*a* and extending to the laterally extending edge 152 of the blank. The blank 103 has curved tear lines 180 extending from a respective opening 171, 173 in the second top panel 110*b* and extending to a laterally extending edge 154 of the blank. The curved tear lines 190 overlap a portion of a respective first portion 179 of the tear lines 175 when the first top panel 110*a* and the second top panel 110*b* are overlapped to form the top panel 111 of the carton 105. Further, the curved tear lines 190 overlap a portion of a respective first portion 185 of the tear lines 177 when the first top panel 110*a* and the second top panel 110*b* are overlapped to form the top panel 111 of the carton 105.

In one embodiment, the blank 103 has lines of weakening 192 (e.g., fold lines) in the first top panel 110*a* and lines of weakening 194 (e.g., fold lines) in the second top panel 110*b*. The lines of weakening 192, 194 are positioned in a respective top panel 110*a*, 110*b* so that the lines of weakening 192 overlap the lines of weakening 194 when the top panel 111 is formed by overlapping the first top panel 110*a* over the second top panel 110*b*. The lines of weakening 192, 194 help facilitate formation of the handle 107 and allow the lifting portion 199 of the carton 105 to flex without tearing when the carton is grasped and lifted at the handle (FIG. 7).

As with the previous embodiment, the carton 105 can be lifted and carried at the handle 107. When the handle 107 is activated and the carton 105 lifted, the tear lines 175, 177 are torn with the tear lines 175, 177 being arranged to prevent additional/uncontrolled tearing or weakening of the material of the carton 105 resulting in a handle 107 that is strengthened. The portion of the carton 105 between the fold lines 113 and tear lines 175, 177 extending therefrom, and the fold line 115 and the tear lines 175, 177 extending therefrom, forms the reinforced lifting portion 199 of the carton 105 that is strengthened by the configuration and controlled tearing of the features of the handle 107. In one embodiment, the lifting portion 199 comprises a portion of the top panel 110 and portions of the side panels 120, 140, but the lifting portion could be otherwise shaped, arranged, and/or configured without departing from the disclosure. Further, the handle panels 112, 114 and openings 171, 173 are sized to limit the number of fingers a user can place through the top panel 111 to activate the handle 107. Limiting the amount of fingers inserted into the handle 107 prevents the tendency for an entire hand to be inserted into the handle which can cause uncontrolled tearing of the carton 105 and weakening of the handle.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines can include: a score line, such as lines formed with a blunt scoring knife, or the like, which creates a crushed portion in the material along the desired line of weakness; a cut that extends at least partially into a material along the desired line of weakness, and/or a series of cuts that extend partially into and/or completely through the material along the desired line of weakness; and various combinations of these features The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, alterations, etc., of the above-described embodiments. It will be understood by those skilled in the art that while the present disclosure has been discussed above with reference to exemplary embodiments, various additions, modifications and changes can be made thereto without departing from the spirit and scope of the claims. Furthermore, certain features and characteristics of each embodiment may be selectively interchanged and applied to other illustrated and non-illustrated embodiments without departing from the scope of the disclosure.

What is claimed is:

1. A carton for carrying a plurality of articles, the carton comprising:

at least one bottom panel;

a first side panel foldably connected to at least one bottom panel;

a second side panel foldably connected to the at least one bottom panel; and a top panel foldably connected to at least one of the first side panel and the second side panel, the top panel has a first width corresponding to a minimum distance between a first edge and a second edge of the top panel;

a handle for grasping and carrying the carton, the handle comprises at least one handle flap foldably connected to the top panel at a fold line, the at least one handle flap has a second width corresponding to a maximum width of the at least one handle flap, the handle includes an opening in the top panel adjacent to the handle flap, the handle flap having a first edge and the top panel having a third edge, the first edge of the handle flap and the third edge of the top panel are free edges and are spaced apart to define the opening, and the opening, the top panel, and the at least one handle flap are coplanar;

the second width is less than the first width, a first line of weakening in the top panel that extends from a first end of the fold line to the first edge of the top panel and a second line of weakening in the top panel that extends from a second end of the fold line to the second edge of the top panel, the first line of weakening and the second line of weakening are straight, and the first line of weakening and the second line of weakening are oblique along the entire length of each respective line of weakening with respect to the first edge and the second edge, and the opening is spaced apart from the first line of weakening and the second line of weakening, and at least one cut defining the at least one handle flap, the at least one cut extends from the opening to at least one of the first line of weakening and the second line of weakening.

2. The carton of claim 1 wherein the first side panel is foldably connected to the top panel at first lateral fold line corresponding to the first edge and the second side panel is foldably connected to the top panel at a second lateral fold line corresponding to the second edge, the fold line connecting the handle flap to the top panel is a longitudinal fold line that is orthogonal relative to the first lateral fold line and the second lateral fold line.

3. The carton of claim 1 wherein the fold line is spaced from an end of the carton by a first distance, the first line of weakening intersects the first edge at a location that is spaced from the end of the carton by a second distance, the second distance being less than the first distance, a first end of the first line of weakening corresponds to the first end of the fold line.

4. The carton of claim 3 wherein the first line of weakening comprises a first portion in the top panel and a second portion in the first side panel that extends from the first edge.

5. The carton of claim 4 wherein the first portion is straight and oblique relative to the fold line and the first edge.

6. The carton of claim 4 wherein the second portion extends generally perpendicular to the first edge and terminates at a J-shaped cut in the first side panel.

7. The carton of claim 4 wherein the second line of weakening comprises a first portion in the top panel and a second portion in the second side panel that extends from the second edge, the first portion of the second line of weakening is straight and oblique relative to the fold line and the second portion of the second line of weakening extends generally perpendicular to the second edge.

8. The carton of claim 7 wherein the second portion of the second line of weakening terminates at a J-shaped cut in the second side panel.

9. The carton of claim 1 wherein the third edge is curved and the fourth edge is curved, and the opening is generally arcuate and defined by the third edge and the fourth edge.

10. The carton of claim 1 wherein the at least one handle flap is a first handle flap, the fold line is a first fold line, and the carton further comprises a second handle flap foldably connected to the top panel at a second fold line, the second handle flap has a maximum width corresponding to the second width of the first handle flap.

11. The carton of claim 10 further comprising a third line of weakening in the top panel that extends from a first end of the second fold line to the first edge of the top panel and a fourth line of weakening in the top panel that extends from a second end of the second fold line to the second edge of the top panel.

12. The carton of claim 11 wherein the second fold line is spaced from an end of the carton by a first distance, the third line of weakening intersects the first edge of the top panel at a location that is spaced from the end of the carton by a second distance, the second distance being less than the first distance.

13. The carton of claim 11 wherein the first line of weakening, second line of weakening, third line of weakening, and fourth line of weakening are tear lines.

14. The carton of claim 1 wherein the second width is at least 30 percent less than the first width.

15. The carton of claim 2 in combination with the plurality of articles, the articles comprising bottles with caps arranged in a first row and a second row in the carton, the bottles having tops that are in contact with the top panel, the first lateral fold line being generally aligned with the centerline of the caps of the bottles in the first row and the second lateral fold line being generally aligned with the centerline of the caps of the bottles in the second row.

16. The carton of claim 1 wherein the at least one bottom panel comprises a first bottom panel foldably connected to the first side panel and a second bottom panel foldably connected to the second side panel.

17. The carton of claim 1 wherein the at least one bottom panel comprises a bottom panel foldably connected to the first side panel and the second side panel.

18. A blank for forming a carton for carrying a plurality of articles, the blank comprising:

at least one bottom panel;

a first side panel foldably connected to the at least one bottom panel;

a second side panel foldably connected to the at least one bottom panel;

at least one top panel foldably connected to at least one of the first side panel and the second side panel, the at least one top panel has a first width corresponding to a minimum distance between a first edge and a second edge of the at least one top panel;

handle features for forming a handle for grasping and carrying the carton formed from the blank, the handle features comprise at least one handle flap foldably connected to the top panel at a first fold line, the at least one handle flap has a second width corresponding to a maximum width of the last least one handle flap, and the handle features include an opening in the top panel adjacent to the handle flap, the handle flap having a first edge and the top panel having a third edge, the first edge of the handle flap and the third edge of the top panel are free edges and are spaced apart to define the opening, and the opening, the top panel, and the at least one handle flap are coplanar;

the second width is less than the first width, and a first line of weakening in the top panel that extends from a first end of the first fold line to the first edge of the at least one top panel and a second line of weakening in the top panel that extends from a second end of the first fold line to the second edge of the at least one top panel, the first line of weakening and the second line of weakening are straight, and the first line of weakening and the second line of weakening are oblique along the entire length of each respective line of weakening with respect to the first edge and the second edge; and the opening is spaced apart from the first line of weakening and the second line of weakening, and at least one cut defining the at least one handle flap, the at least one cut extends from the opening to at least one of the first line of weakening and the second line of weakening.

19. The blank of claim 18 wherein the first side panel is foldably connected to the top panel at first lateral fold line corresponding to the first edge and the second side panel is foldably connected to the top panel at a second lateral fold line corresponding to the second edge, the fold line connecting the handle flap to the top panel is a longitudinal fold line that is orthogonal relative to the first lateral fold line and the second lateral fold line.

20. The blank of claim 18 wherein the fold line is spaced from an end of the at least one top panel by a first distance, the first line of weakening intersects the first edge at a location that is spaced from the end of the at least one top panel by a second distance, the second distance being less than the first distance.

21. The blank of claim 20 wherein the first line of weakening comprises a first portion in the top panel and a second portion in the first side panel that extends from the first edge.

22. The blank of claim 21 wherein the second line of weakening comprises a first portion in the top panel and a second portion in the second side panel that extends from the second edge, the first portion of the second line of weakening is oblique relative to the fold line and the second portion of the second line of weakening extends generally perpendicular to the second edge.

23. The blank of claim 18 wherein the third edge is curved and the fourth edge is curved, and the opening is generally arcuate and defined by the third edge and the fourth edge.

24. The blank of claim 18 wherein the at least one handle flap is a first handle flap, the fold line is a first fold line, and the carton further comprises a second handle flap foldably connected to the at least one top panel at a second fold line, the second handle flap has a maximum width corresponding to the second width of the first handle flap.

25. The blank of claim 24 further comprising a third line of weakening in the at least one top panel that extends from a first end of the second fold line to the first edge of the at least one top panel and a fourth line of weakening in the at least one top panel that extends from a second end of the second fold line to the second edge of the at least one top panel.

26. The blank of claim 18 wherein the second width is at least 30 percent less than the first width.

27. The blank of claim 18 wherein the at least one bottom panel comprises a first bottom panel foldably connected to the first side panel and a second bottom panel foldably connected to the second side panel.

28. The blank of claim 18 wherein the at least one bottom panel comprises a bottom panel foldably connected to the first side panel and the second side panel.

* * * * *